United States Patent [19]

Kooiman et al.

[11] Patent Number: 4,929,254

[45] Date of Patent: May 29, 1990

[54] DOWN-DRAFT FIXED BED GASIFIER SYSTEM

[75] Inventors: Cornelis A. Kooiman, Rhoon, Netherlands; John J. McDevitt, Sr., Bow, N.H.

[73] Assignee: SET Technology B.V., Goes, Netherlands

[21] Appl. No.: 379,590

[22] Filed: Jul. 13, 1989

[51] Int. Cl.[5] ..... C10J 3/26; C10J 3/42

[52] U.S. Cl. ..... 48/76; 48/66; 48/85.2; 48/111

[58] Field of Search ..... 48/76, 77, 66, 111, 48/209, 85.2, 61, 203; 110/229

[56] References Cited

U.S. PATENT DOCUMENTS

| | | | |
|---|---|---|---|
| 1,821,263 | 9/1931 | Imbert | 48/76 |
| 1,849,279 | 3/1932 | Cezanne | 48/76 |
| 1,984,665 | 12/1934 | Tone | 48/76 |
| 3,547,055 | 12/1970 | Zanft | 110/8 |
| 3,741,133 | 6/1973 | Kleinfelter | 110/8 A |
| 3,881,885 | 5/1975 | Wagner | 48/76 |
| 4,011,059 | 3/1977 | Daly et al. | 48/85.2 |
| 4,258,005 | 3/1981 | Ito et al. | 48/111 |
| 4,306,506 | 12/1981 | Potter | 48/76 |
| 4,309,195 | 1/1982 | Potter | 48/111 |
| 4,344,772 | 8/1982 | Pillard | 48/66 |
| 4,348,211 | 9/1982 | Zimmerman | 48/76 |
| 4,459,136 | 7/1984 | Linnebaum et al. | 48/76 |
| 4,481,014 | 11/1984 | Dorling | 48/76 |
| 4,507,127 | 3/1985 | Hirose | 48/89 |
| 4,583,992 | 4/1986 | Rogers | 48/76 |
| 4,659,340 | 4/1987 | Weaver | 48/76 |

FOREIGN PATENT DOCUMENTS

| | | | |
|---|---|---|---|
| 3239624 | 4/1984 | Fed. Rep. of Germany | 48/111 |
| 2056480 | 3/1981 | United Kingdom | 48/76 |

*Primary Examiner*—Peter Kratz

*Attorney, Agent, or Firm*—Lahive & Cockfield

[57] ABSTRACT

A gasifier system for obtaining relatively clean combustible gaseous products from solid fuel materials, such as processed sewage sludge, comprises a gasifier reactor which communicates a raw, combustible gas to a cyclone separator, a gas scrubbing device and a gas cooling and drying device. Gas which exits the system is relatively clean and may be used in a prime mover for the production of energy.

The gasifier reactor of the present invention is a downdraft fixed bed gasifier. The gasifier is constructed of several interconnected modular units. Moreover, the gasifier is constructed so as to efficiently gasify fuel materials while maintaining excellent horizontal temperature control.

23 Claims, 9 Drawing Sheets

DOWN-DRAFT FIXED BED GASIFIER SYSTEM

BACKGROUND OF THE INVENTION

1. Field of the Invention

The present invention is directed to down-draft fixed bed gasifiers for converting biomass material such as wood and processed sewage sludge to a low BTU combustible gas. More particularly the invention is directed to such a gasifier having a cleaning system for processing the gas produced from the gasifier.

2. Background of the Invention

The expense and potential shortage of petroleum-based fuels makes the use of biomass fuel an attractive alternative. At the same time, biomass materials such as wood waste and other wastes such as sewage and/or industrial sludge are in abundant supply in most parts of the world. Indeed, supplies of such materials are so extensive that disposal of wood waste and sludge has become a problem. It would be advantageous to efficiently dispose of such materials and, at the same time, obtain useful fuel products from them.

Gasifiers which convert wood products, garbage and biomass materials to combustible gases are disclosed, for example, in U.S. Pat. Nos. 4,659,340; 4,583,992; and 4,348,211. However, many currently known gasifiers lack efficiency because it is difficult to achieve acceptable horizontal temperature control (i.e., stratified horizontal zones of constant temperature) within the gasifiers. Moreover, many known gasifiers may product combustion by-products which have a high ash and particulate matter content. Accordingly, there is a need for an apparatus which will efficiently convert biomass materials (i.e., wood scrap and sewage sludge) to useful fuel products.

SUMMARY OF THE INVENTION

A primary objective of the present invention is to provide a gasification apparatus which efficiently converts biomass materials such as wood waste, sewage sludge and other such organic compositions, having up to 25 percent inorganics, to a useful, combustible gas. Another objective of the invention is to provide a gasifier apparatus in which horizontal temperature control within the gasifier is easily obtained and maintained. A further objective of the invention is to provide a gasification apparatus in which the various components which constitute the apparatus are modular and exchangeable with other such components having different features and characteristics. It is also an objective of the invention to provide a gasification apparatus and a cleaning system for such an apparatus which yields a relatively dry and clean combustible gas. Other objectives of the invention will be apparent to those having ordinary skill in the art upon reading this disclosure.

The above objects are accomplished by providing a gasification system, including a gasifier reactor, a scrubber apparatus and a dryer apparatus, which efficiently converts biomass materials such as sewage sludge, other organic wastes and wood waste to a low BTU combustible gas.

The gasifier apparatus is of the type known as a down-draft fixed bed gasifier. Generally, the gasifier is a vertically-oriented apparatus, having an uppermost portio which comprises a hopper for receiving solid fuel. The fuel may be communicated through the hopper and selectively operable seals, to vertical, adjacent chambers in which the fuel is first dried and preheated, and then gasified. The seal assembly preferably is an air-tight, electric, hydraulic or pneumatic sliding gate valve which is positioned below the hopper. Optionally, a second hopper, followed by a second seal assembly, may be disposed below the first seal assembly for more efficient and safe operation of the gasifier.

The vertical chambers of the gasifier comprise a first, drying chamber, and intermediate and lower gasification chambers. The chambers are modular units which are vertically aligned and in direct communication with each other. The inner walls of each chamber are generally constructed so as to be slightly diverging. However, some portions of the intermediate and lower chambers may have inwardly diverging walls as disclosed hereinafter.

The intermediate chamber, which hosts the highest temperature during the gasification reaction, features air inlets which extend through the outer skin of the gasifier to enable air to be drawn into the gasifier during the gasification process in order to promote and maintain the gasification reaction.

An annular flange extends downwardly from the intermediate chamber into the lower chamber. Within the lower chamber a gas discharge passageway is formed between the outer walls of the flange and the inner walls of the lower chamber. The gas produced as a result of the gasification reaction is drawn downwardly within the gasifier from the intermediate and lower chambers where the gas is generated, then upwardly into the gas discharge pathway. At the top of the gas discharge pathway the gas is withdrawn from the gasifier through two gas discharge conduits which extend through the gasifier wall on opposite sides of the gasifier.

An eccentrically rotatable grate is disposed at a bottom portion of the lower chamber. The grate serves as a base upon which fuel may rest, and also provides a means for breaking clinkers and ash particles into smaller units. In addition, the grate has a number of openings through which ash particles may pass to a collection chamber disposed below the lower gasification chamber of the gasifier. The collection chamber may be emptied of its contents by an auger or a discharge screw.

The gasification system also includes several elements to clean, dry and cool the gas generated by the gasification process. One or more cyclone separators for removing larger particulate wastes entrained with the gas communicate with the gas discharbe conduits of the gasifier. After the gas is passed through the gas discharge pathway it proceeds downstream to a gas scrubbing and cooling unit and finally to a gas drying unit. Upon exiting the gas drying unit the gas may be transported to a prime mover for the production of energy. Alternatively, the gas may be fed into a prime mover, boiler or incinerator immediately after exiting the cyclone separator if purity of the gas is not essential.

The gas scrubbing and cooling apparatus of the present invention comprises a circuitous passageway through which the gas passes. This passageway is interrupted by several baffle regions which alter the flow rate of the gas and provide an increased surface area to facilitate the removal of solids from the gas. In addition, gas flowing through the scrubber is contacted by a fluid spray which further facilitates the removal of solids.

The gas drying apparatus generally comprises a vertically oriented structure which houses filters and baffle regions to facilitate the removal of moisture and solids from the gas.

The gasifier system of the present invention is designed to be useful for the gasification and subsequent treatment of a variety of fuels. For example, the fuels which may be utilized with the present system include organic and biomass materials such as wood scrap, processed sewage sludge, and processed manures, as well as conventional fuel materials such as coal. The fuels which may be burned in the present gasifier apparatus may also include those which have relatively low BTU values (i.e., less than 11,000 BTU) as well as those possessing higher BTU values. Moreover, the size of the gasifier apparatus may be modified to accommodate specific applications. Thus, the following disclosure refers to embodiments which are desirable for smaller gasifier units (60–110 kwe) as well as for larger units (greater than 110 kwe) and very large units (about 180 kwe).

BRIEF DESCRIPTION OF THE DRAWINGS

For a fuller understanding of the nature and objects of the invention, reference should be made to the following detailed description and accompanying drawings, in which.

DETAILED DESCRIPTION OF THE PREFERRED EMBODIMENTS

Figure 1:
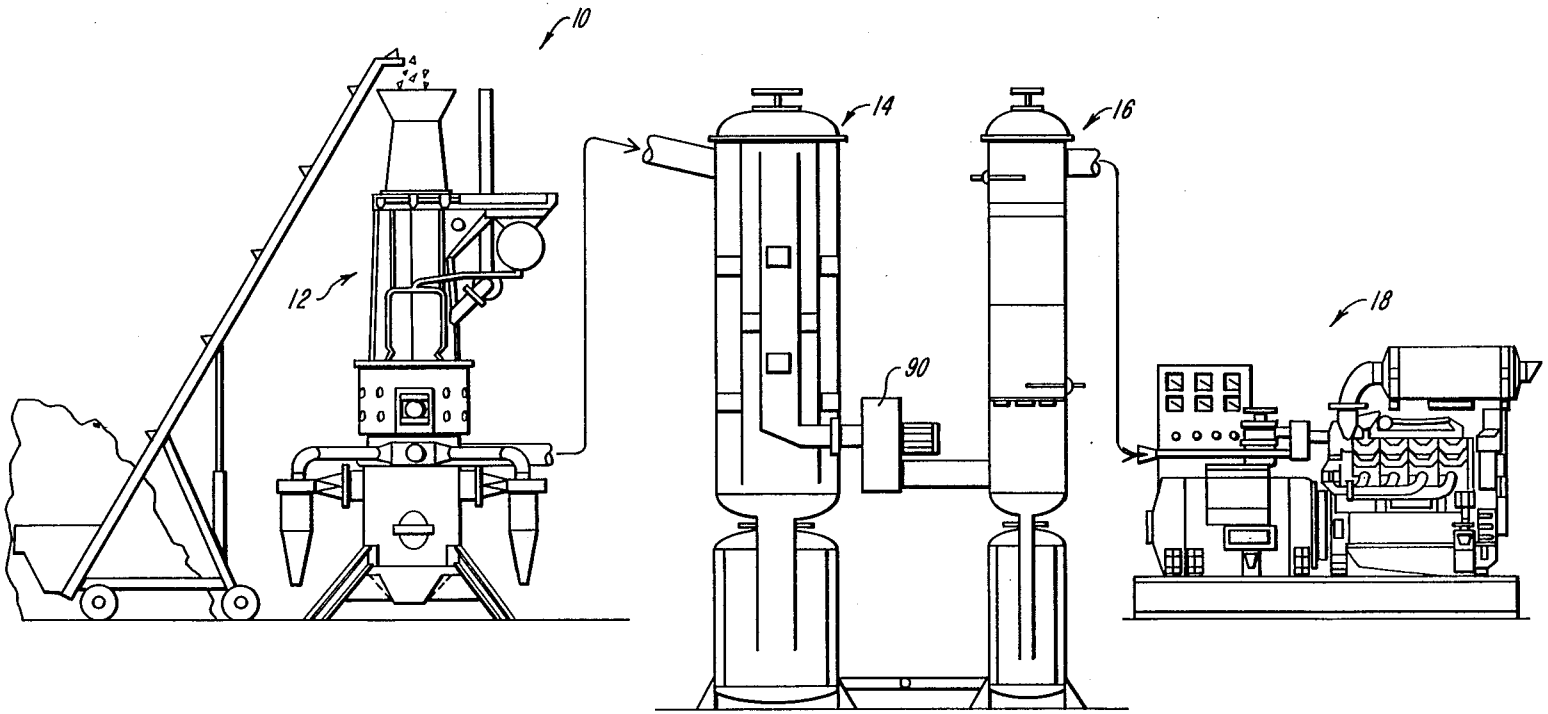
FIG. 1 is a schematic view of the gasifier system of the present invention including the gasifier reactor apparatus, the scrubber and dryer apparatus.

Referring to FIG. 1, gasification system 10 generally includes a gasifier 12, a gas scrubbing and cooling apparatus 14 and a gas drying apparatus 16. The gasifier 12 converts a solid fuel to a useful, combustible gas which is cleaned, cooled, and dried by scrubbing apparatus 14 and drying apparatus 16. Following the cleaning and drying operation, the gas may be delivered to a prime mover 18 or similar apparatus to produce energy either before the gas cleaning and drying operations (if a clean fuel is not essential), or after the cleaning and drying operations (if a clean fuel is desirable).

The gasifier of the present invention is advantageous as it provides excellent horizontal temperature control within the portions of the gasifier where gasification occurs. That is, within the gasification chambers of gasifier 12, the temperature at a given point is substantially constant across a horizontal cross section of the gasifier at that point. Such horizontal temperature control facilitates efficient gasification.

The gasifier apparatus 12 of the present invention may be used to convert a variety of solid fuel materials, having either high or low BTU values, to a useful, combustible gas. The gasifier apparatus may range in size from small (i.e. 60–110 kwe output) to large (i.e. over 110 kwe output). Gasifier 12 may be a vertically-oriented device with a generally cylindrical shape. Referring to FIGS. 2 through 5, the gasifier 12 comprises a hopper 20 which is disposed above a seal assembly 22 which may take the form of a sliding gate valve. Disposed directly below the sealing apparatus 22 is a drying chamber 24 which represents a first chamber of the gasifier reactor. An intermediate chamber 26 which forms a gasification chamber is disposed directly below and in communication with the drying chamber 24. A lower chamber 28, which forms a second gasification chamber, is disposed directly below and in communication with intermediate chamber 26. An end cap 9 forms the bottom-most portion of the gasifier, providing a collection chamber for ash waste while also sealing the bottom of the gasifier to the outside environment. Preferably, the end cap 29 does not rest on the ground, but is instead supported by legs 30.

Each of the components of gasifier 12 is a modular unit which is independent of other components of the gasifier. The modular design enables the various modules to be interchangeable and useable with the other modular components having different sizes or characteristics. It should also be appreciated that chambers 24, 26 and 28 are each bottomless modules which are in direct communication with each other.

Figure 2:
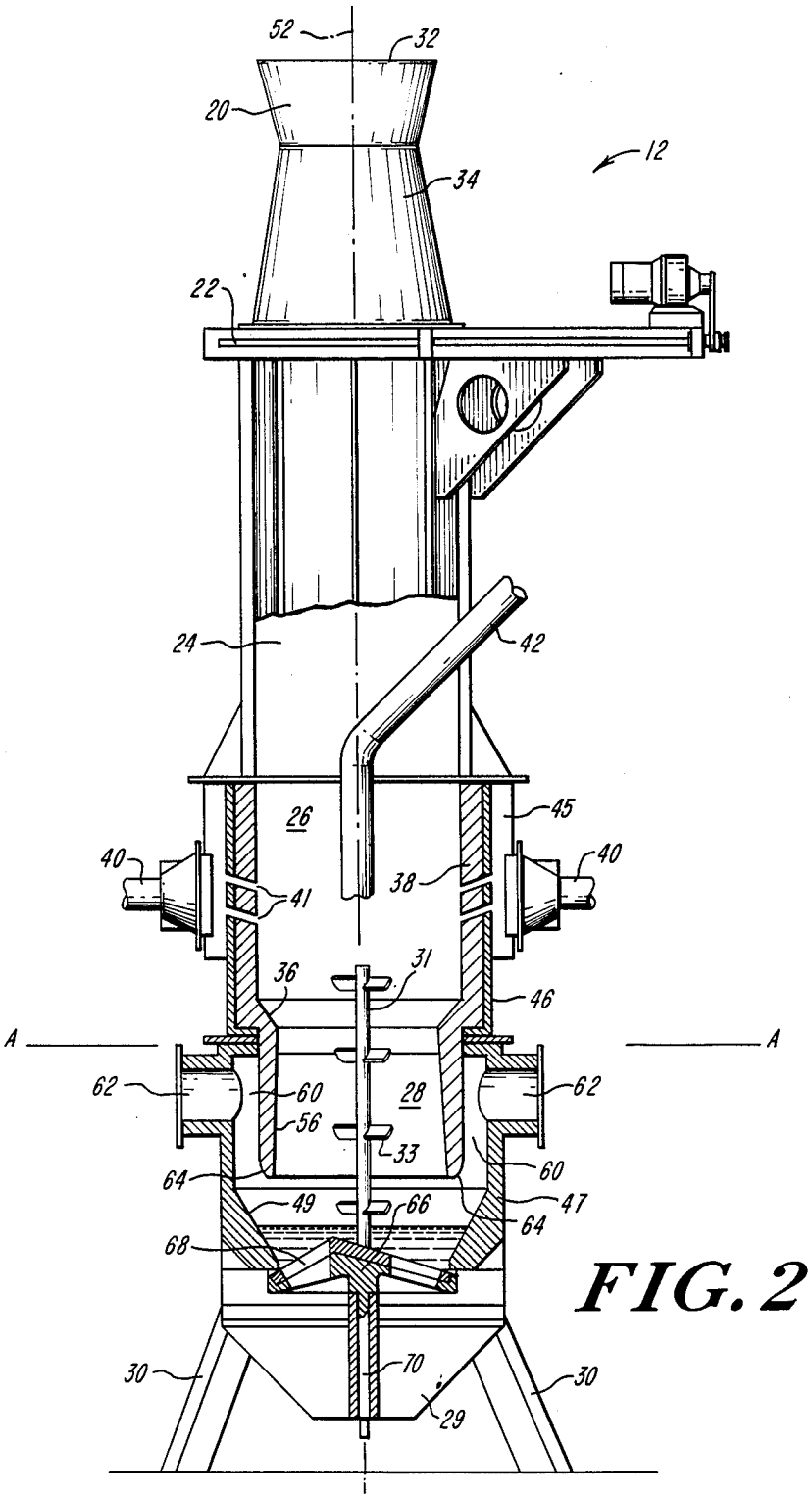
FIG. 2 is a sectional view, partially cut away, of the gasifier reactor apparatus of the present invention in which the portion below section A—A has been rotated 90°.

As best shown in FIG. 2, gasifier 12 may also include a rate 66 disposed at a bottom portion of chamber 28. Grate 66 preferably is eccentrically rotatable, having a high point offset from its center. Moreover, grate 66 includes elongate openings 68 which facilitate the removal of ash waste from the interior of gasifications chambers 26 and 28 to a collecton chamber within end cap 29. Grate 66 is rotated by shaft 70 which may be driven by a suitable motor (not shown).

A stirring rod 31 may, optionally, be mounted upon grate 66 and extend upwardly therefrom into gasification chambers 26 and 28. Stirring rod 31 aids in dispersing the fuel so as to avoid the formation of "hot spots" within chambers 26 and 28 during the gasification process. Stirring rod 31 can have radial paddle elements 33 which assist in dispersing the fuel.

FIG. 2 illustrates one embodiment of the invention generally suitable for both smaller and larger gasifier units. This embodiment features a single hopper 20 and seal 22. The hopper 20 features a generally circular or rectangular opening 32 having inwardly diverging walls. The opening 32 leads to a hopper chamber 34, where fuel is temporarily stored. Hopper chamber 34 has a generally cylindrical shape with outwardly diverging walls. Fuel which is input to the hopper chamber 34 is prevented from entering the drying chamber 24 by sealing assembly 22. Once seal 22 is opened, the fuel will flow directly into chambers 24, 26 and 28 and will rest on grate 66.

Figure 8:
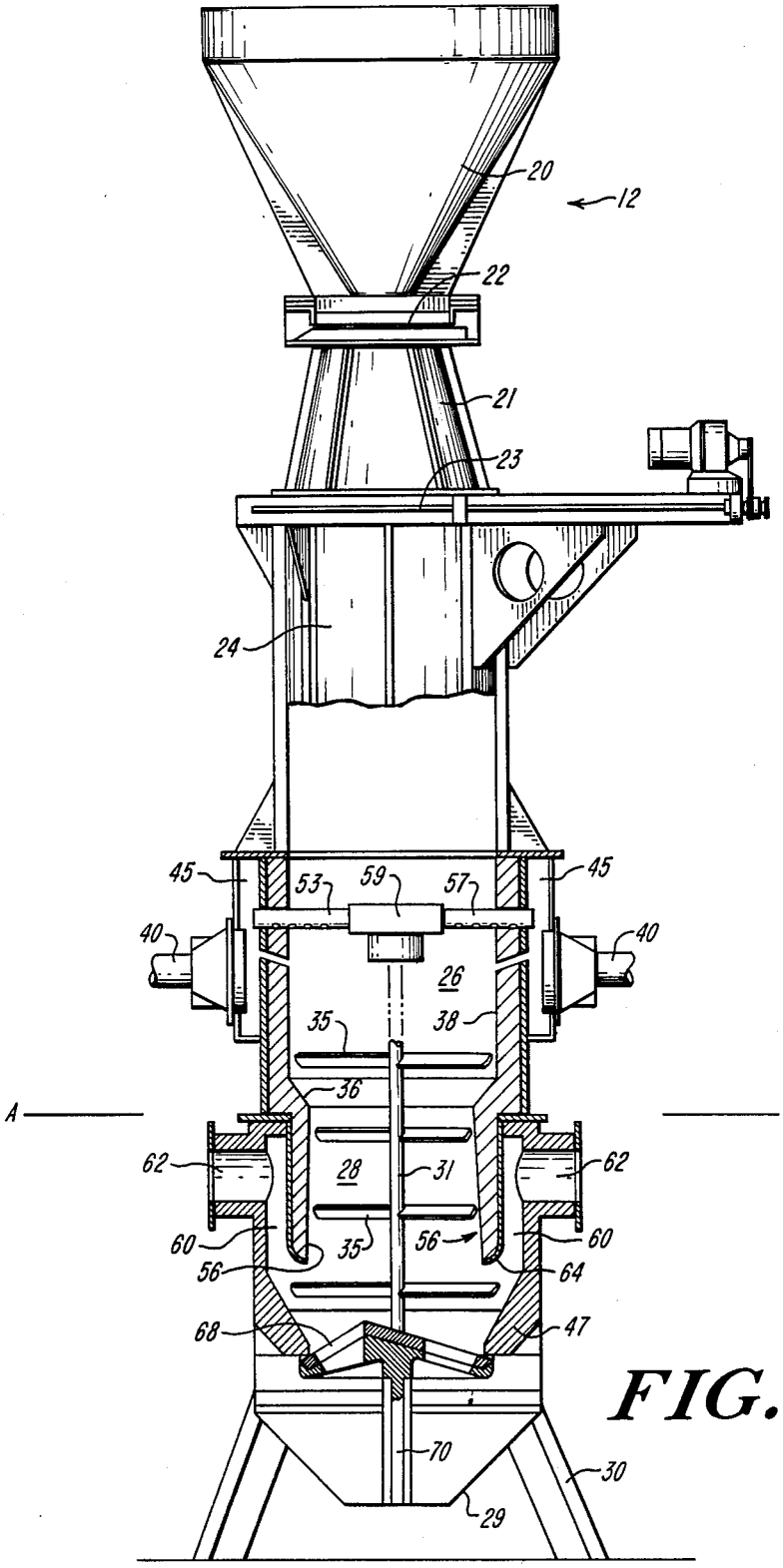
FIG. 8 is a sectional view, partially cut away, of an alternative embodiment of the gasifier of the present invention in which the portion below section A—A has been rotated 90°.

FIG. 8 illustrates another embodiment of the invention, generally well-suited for very large gasifier units (e.g., 180 kwe). In this embodiment, the gasifier 12 features a secondary hopper 21, disposed below seal assembly 22, and a secondary seal assembly 23, disposed below secondary hopper 21. One advantage of this embodiment is that, with the use of a secondary hopper 21 and a secondary seal 23, the gasifier is rendered essentially free of air drafts entering the reactor from the hopper 20. The seals 22, 23 are designed such that at least one of the two seals will be closed at all times. Thus, when fuel is added to the reactor, the first seal 22 is opened while the secondary seal 23 remains closed. Seal 22 will close only after the secondary hopper 21 has been charged with fuel. Secondary seal 23 is not opened until after first seal 22 is closed.

The dimensions of hoppers 20, 21 are not critical to the operation and efficiency of the gasification apparatus, as long as they are of a size sufficient to accommodate a suitable amount of fuel to efficiently practice the gasification process. Those having ordinary skill in the art may easily design a hopper module useful with the present gasification apparatus.

The hoppers 20, 21 and seals 22, 23 are each modular components which may be removed and replaced with other components independent of each other, having different features, dimensions or characteristics.

Referring again to FIGS. 2 and 8, in a preferred embodiment of the invention drying chamber 24 is a substantially cylindrically shaped module having side walls which taper outwardly. The drying chamber 24 preferably is constructed of a single inner wall. The inner wall of the drying chamber may be constructed of a steel or stainless steel compound. In another embodiment of the invention (not shown), useful with fuels having high moisture contents, drying chamber 24 may have a double inner wall construction in which the innermost wall is constructed of a stainless steel material which has a multitude of perforations. Moisture is removed through the perforations in the innermost wall and collected and withdrawn through a drain element incorporated between the two walls. The modular feature of the present gasifier apparatus facilitates efficient modification of the gasifier by simply exchanging a module for chamber 24, (e.g., one similar to that described with respect to a preferred embodiment) with another having different features or characteristics (e.g., a double wall construction).

The intermediate chamber 26 is also a modular unit which may be bolted or similarly joined to the bottom portion of drying chamber 24. Chamber 26 has inner walls which diverge outwardly to a slight degree until reaching a lower, keel portion 36, which has inwardly diverging walls as best shown in FIG. 2. The intermediate chamber 26 preferably has a single inner wall 38 made of a refractory ceramic material or refractory cement. In a preferred embodiment, a refractory cement is poured into a mold of a desired shape to form chamber 26.

In an embodiment desirable for use with larger gasifier units (e.g., approximately 110 kwe), illustrated in FIG. 2, chamber 26 has dual radial air inlet conduits 40 and axial air inlet conduit 42 which supply to the gasifier air necessary for the pyrolysis reaction. Radial inlet conduits 40 are disposed exterior of and adjacent to opposite sides of chamber 26. The conduits 40 communicate with an annular manifold 45 which surrounds the gasifier and extends through outer shell 46 and refractory wall 38 of chamber 26. The annular manifold 45 disperses incoming air into nozzles 41 disposed within the walls of chamber 26, in both upper and lower rows, about the circumference of chamber 26. The manifold 45 includes a diverter valve (not shown) which directs air flowing from manifold 45 into chamber 26 by way of the upper and/or lower row of nozzles. Both the upper and lower row of nozzles direct air into the chamber 26 at a slight downward angle. Chamber 26 typically preferably has approximately 20 to 30 nozzles in each row.

Figure 3:
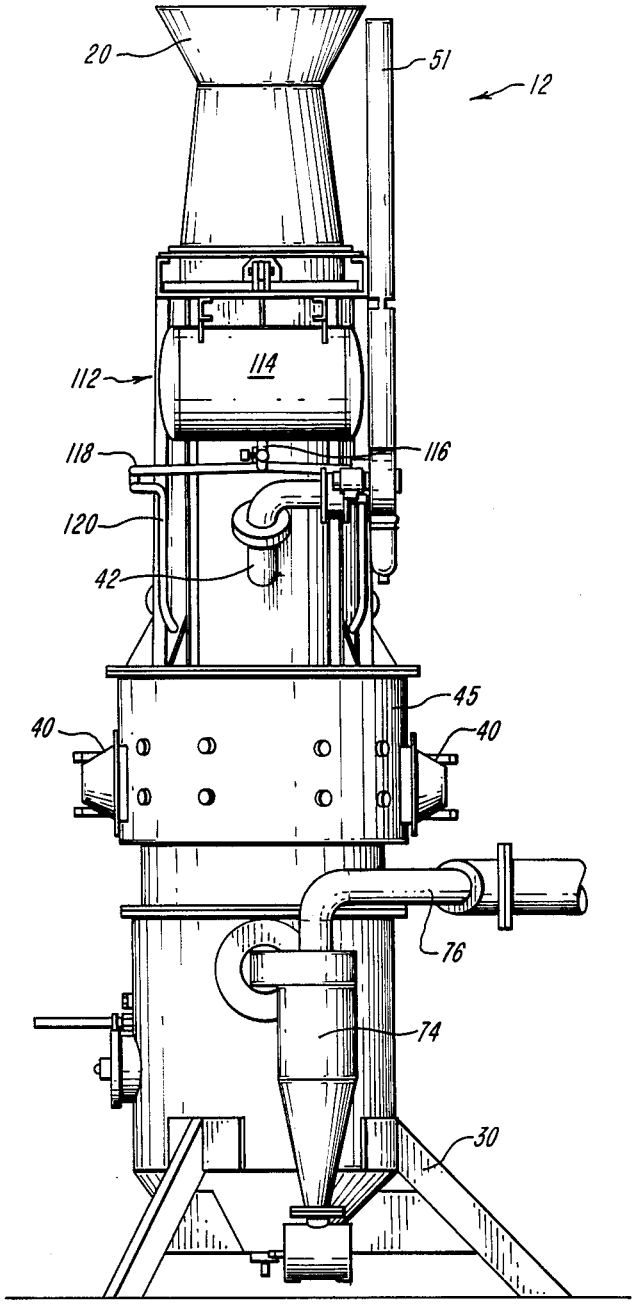
FIG. 3 is a front view of the gasifier apparatus of FIG. 1.
Figure 4:
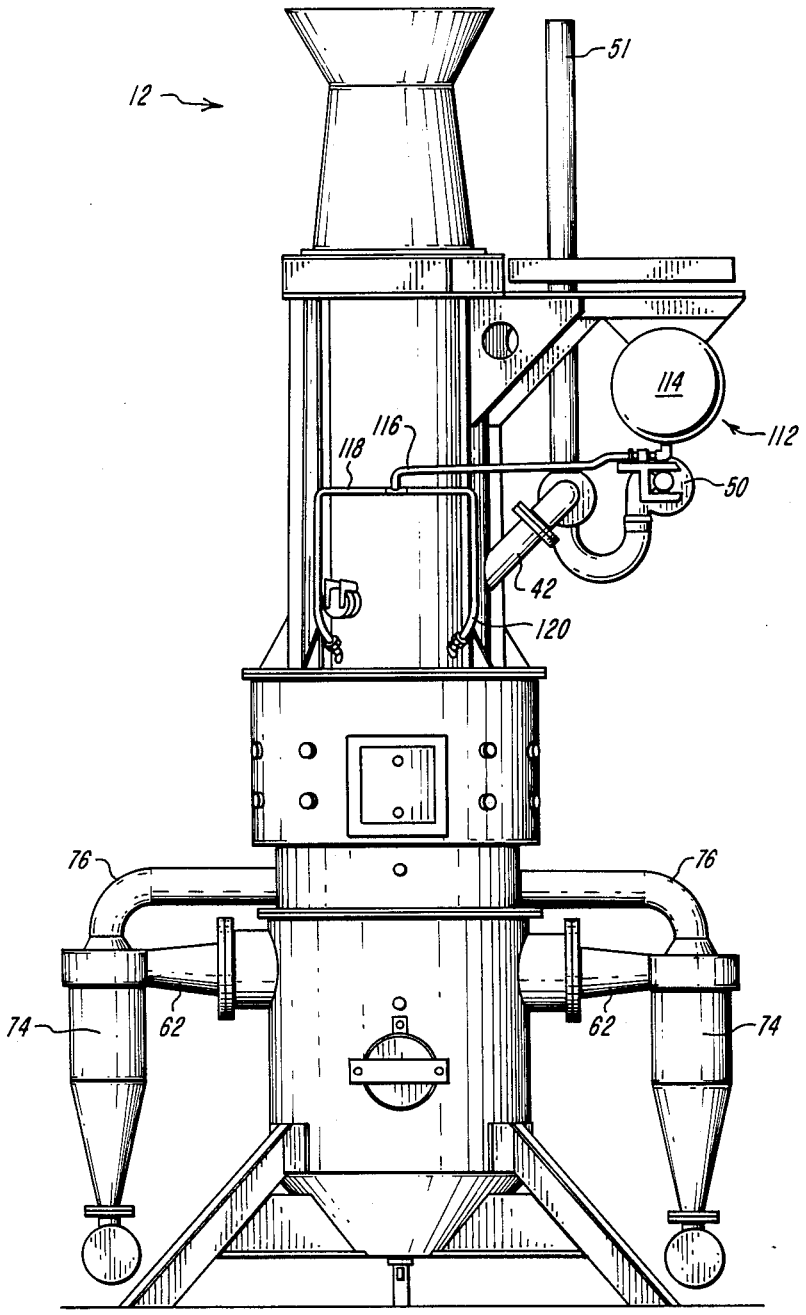
FIG. 4 is a side view of the gasifier apparatus of FIG. 1.

Axial air inlet conduit 42 extends angularly through the wall of drying chamber 24 and downwardly into the center of chamber 24 as shown in FIGS. 2, 3 and 4. Referring to FIG. 2, conduit 42 bends within chamber 24 to extend downwardly into preliminary gasification chamber 26, becoming coaxial with the longitudinal axis 52 of gasifier apparatus 12. Conduit 42 terminates in a nozzle (not shown). The nozzle of conduit 42 may be of a variety of designs. For example, it may be capped at the bottom and open at the sides to allow air to exit in a substantially horizontal manner. Alternatively, the nozzle of conduit 42 may have a baffle which causes air to flair upon exiting the nozzle. In yet another embodiment, the nozzle may include extension pipes (not shown) which direct the air further into chamber 26.

For smaller gasifier units (e.g., 60–80 kwe), chamber 26 may be slightly modified by eliminating axial inlet conduit 42. The nozzles 41 supply an amount of air sufficient for such units.

Figure 9:
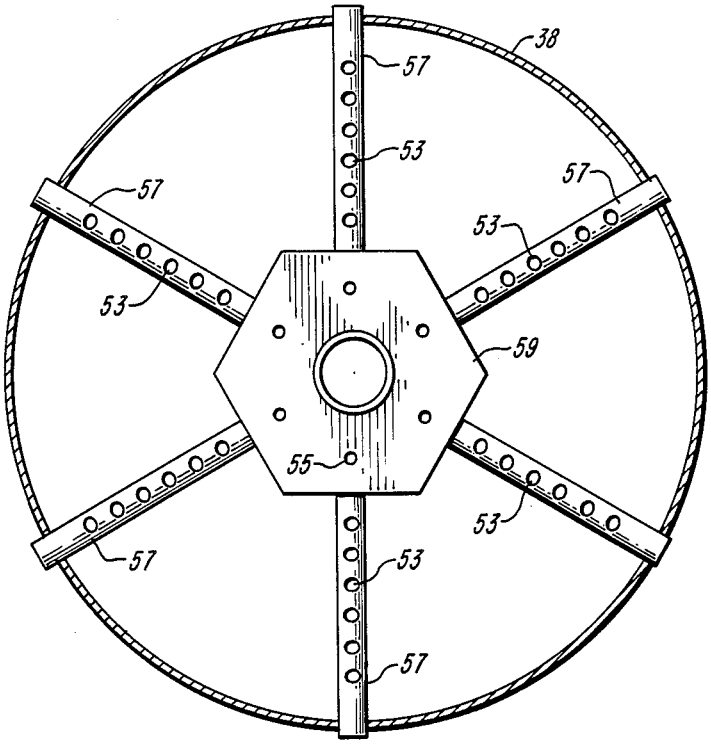
FIG. 9 is a bottom view of the internal air inlet apparatus used with the embodiment of FIG. 8.

For very large gasifier units (e.g., 180 kwe), chamber 26 may feature an air inlet system as shown in FIGS. 8 and 9. Referring to FIG. 8, radial air inlet conduits 40 communicate with manifold 45 which, in turn, communicates with internal air supply pipes 57, connected between manifold 45 and an internal air manifold 59. Internal air supply pipes 57 each include a multitude of outlet nozzles 53 for distributing air into chamber 26. Internal air manifold 59 also includes similar nozzles 55 for releasing air into chamber 26. Preferably, nozzles 53 and internal air supply pipes 57 are disposed in a side of pipes 57 facing away from the direction in which stirring rod 31 turns the fuel.

In each of the above embodiments, the air inlet conduits communicate with a fan 50 which, when desired, may force air into the gasifier. Fan 50 draws outside air from a vent stack 51 for disposal within the gasifier. Generally, fan 50 is necessary to force air into chamber 26 only at the initiation of the gasification reaction. After the initiation of the reaction, a vacuum force is created by a blower unit 90 located downstream of gasifier 12. The vacuum force draws air into the gasifier 12 through vent stack 51.

Also shown in FIG. 8 is stirring rod 31 which includes stirring flanges 35 (instead of radial paddles 33) to disperse the fuel. Flanges 35 are disposed within chamber 26 extending throughout the length of chamber 26 from a location just below internal pipes 57 to the keel 36 of chamber 26. Moreover, each flange is of a width sufficient to allow it to extend substantially from the stirring rod 31 to the inner wall of chamber 26. Flange 35 is adapted to rotate in a chosen direction so as to completely turn the fuel within chamber 26.

Moreover, in order to protect stirring rod 31 from damage due to melting, where extremely high temperatures will be encountered within the gasifier, water may be passed upwardly though rod 31. As the water ascends through rod 31, it is converted to steam as it exits through nozzles 55 in internal manifold 59. This feature also aids in controlling temperatures within the gasifier.

Referring to FIGS. 3 and 4, apparatus 12 may also include a water spray assembly 112. Water spray assembly 112 comprises a water storage tank 114 having attached thereto water conduit 116. Water conduit 116 delivers water to conduit 118 which, in turn, leads to conduits 120. Conduits 120 extend through the wall of drying chamber 24 and deliver a water spray into the bottom portion of chamber 24 and intermediate chamber 26. The water spray assembly is selectively operable and is useful in providing additional temperature control within the gasifier apparatus 12.

Lower gasification chamber 28, like chambers 24 and 26, also forms a modular unit which may be joined with the other components of apparatus 12. Chamber 28 is bolted or similarly secured to the bottom of the module which forms chamber 26. The top portion of this chamber is substantially cylindrical in shape, having inner walls 47 which diverge outwardly throughout most of its length. At a lower portion of chamber 28 the inner walls 47 diverge inwardly, but never meet, to form a bottom portion 49 of chamber 28. The inner walls 47 of chamber 28 are also constructed of the type of refractory material described with respect to chamber 26.

Additional temperature control within chambers 26 and 28 may be provided by internal cooling lines (not shown) disposed within the walls of chambers 26 and 28. In this embodiment chambers 26 and 28 both feature a double interior wall wherein each interior wall is constructed of stainless steel. Cooling lines may be disposed between the two walls.

Referring to FIGS. 2 and 8, within the top portion of chamber 28 is an annular flange 56 which is integral with and extends downwardly from the innermost wall 38 of chamber 26. The flange 56 is spaced apart from the inner wall of chamber 28 by a slight distance, for example, by approximately 3–4 inches. The gap between the outer wall of flange 56 and the inner wall 47 of chamber 28 forms a gas discharge pathway 60. Gas discharge pathway 60 leads to radial gas discharge conduits 62 which remove the combustible gas produced by the gasification process from apparatus 12 and transport it to downstream processing stations. Discharge conduits 62 are offset by an angle of approximately 45° to 90° from radial air inlets 40, thereby allowing advantageous circulation of air and gas before the gas exits the gasifier through discharge conduits 62. (For the purposes of illustration the bottom portions of the gasifiers shown in FIGS. 2 and 8 have been rotated 90°.) In addition, the bottom edges 64 of flange 56 are rounded in order to reduce eddies and currents in the vicinity of discharge conduit 62.

The bottom portion 49 of chamber 28, which begins slightly below flange 56, is characterized by inwardly diverging walls. The bottom-most portion of chamber 28 is occupied by an eccentrically rotatable grate 66 (best shown in FIGS. 2 and 8) which has slot-like openings 68. As noted above, grate 66 is mounted upon a rotatable support shaft 70. The grate serves as a base upon which any fuel added to the system may rest during gasification. Additionally, ash particles and any "clinkers" which may form during the gasification process are broken up by the eccentric rotation of grate 66 and fall beneath grate 66 through holes 68. Ash particles and clinkers are collected in a chamber formed within end cap 29 which lies beneath the grate 66. These accumulated wastes may be removed through conventional methods using, for example, an auger (not shown) or a discharge screw (not shown).

Slots 68 of grate 66 may have serrated edges (not shown) which may cooperate with a stationary bar (not shown) to assist in the breaking up of clinkers. The stationary bar may be disposed a predetermined distance above grate 66 such that clinkers lodged between the bar and the serrated edges of the slots are broken up so as to easily pass through slots 68.

Figure 5:
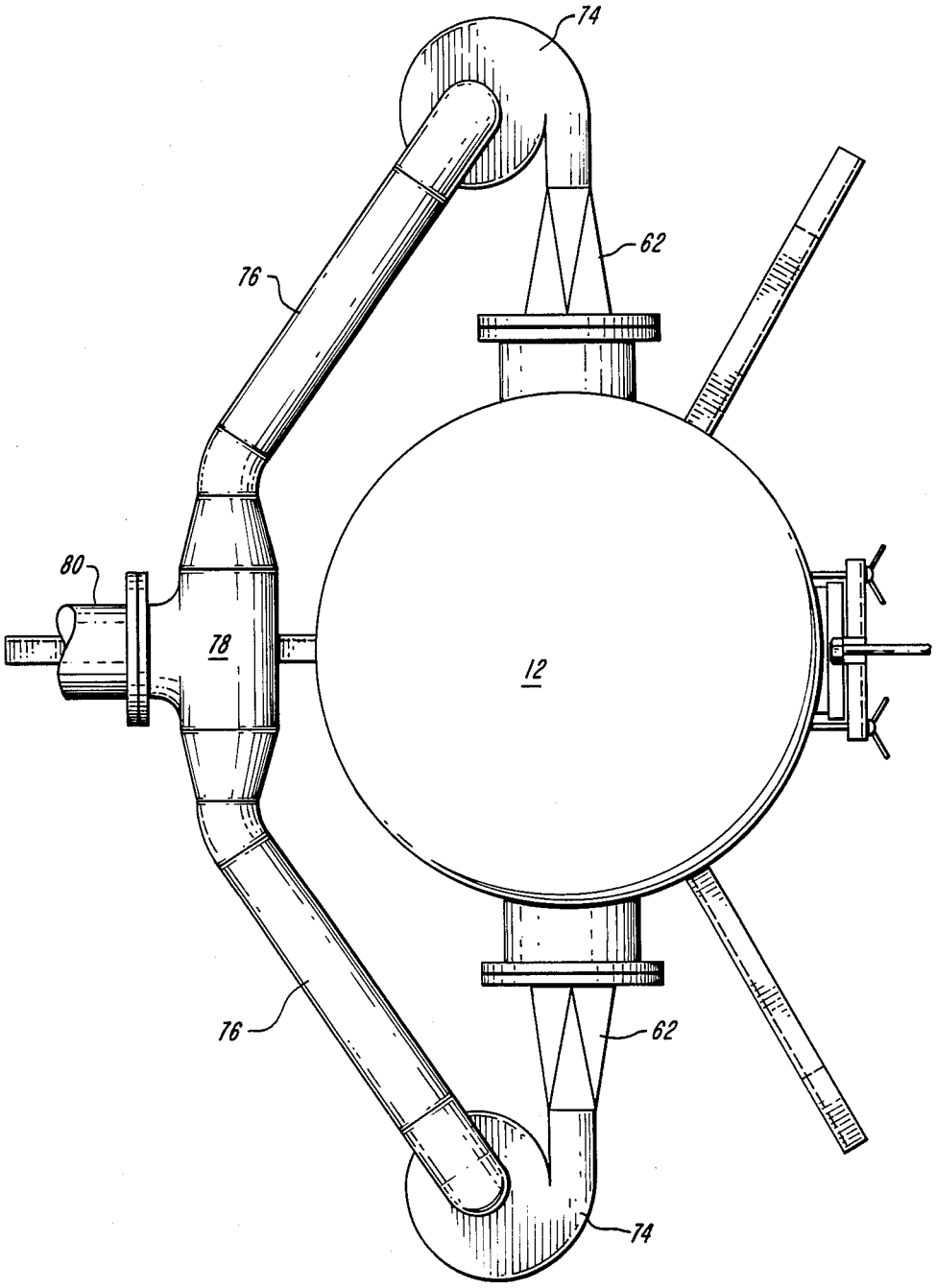
FIG. 5 is a top view of the gasifier apparatus of FIG. 1.

As shown in FIGS. 3, 4 and 5, gas discharge conduits 62 each lead to cyclone particle separator units 74. For larger capacity gasifiers, conduits 62 preferably lead to a single, larger cyclone separator unit which may replace separator units 74. The single separator unit (not shown) may be disposed between the gasifier apparatus 12 and scrubber apparatus 14. The gas discharge conduits enter the cyclone particle separators 74 (or alternatively a single separator unit) at top portions thereof. The gas exiting cyclone separator(s) proceeds through conduits 76 to connector 78 and then to downstream processing stations.

The cyclone separator units 74, or a single separator unit, can be of virtually any type generally known in the art, and are designed to remove larger particulate wastes which are entrained with the exiting gas. The dimensions of the cyclone separator units may be easily determined by those having ordinary skill in the art to accommodate a given gasifier unit.

Figure 6:
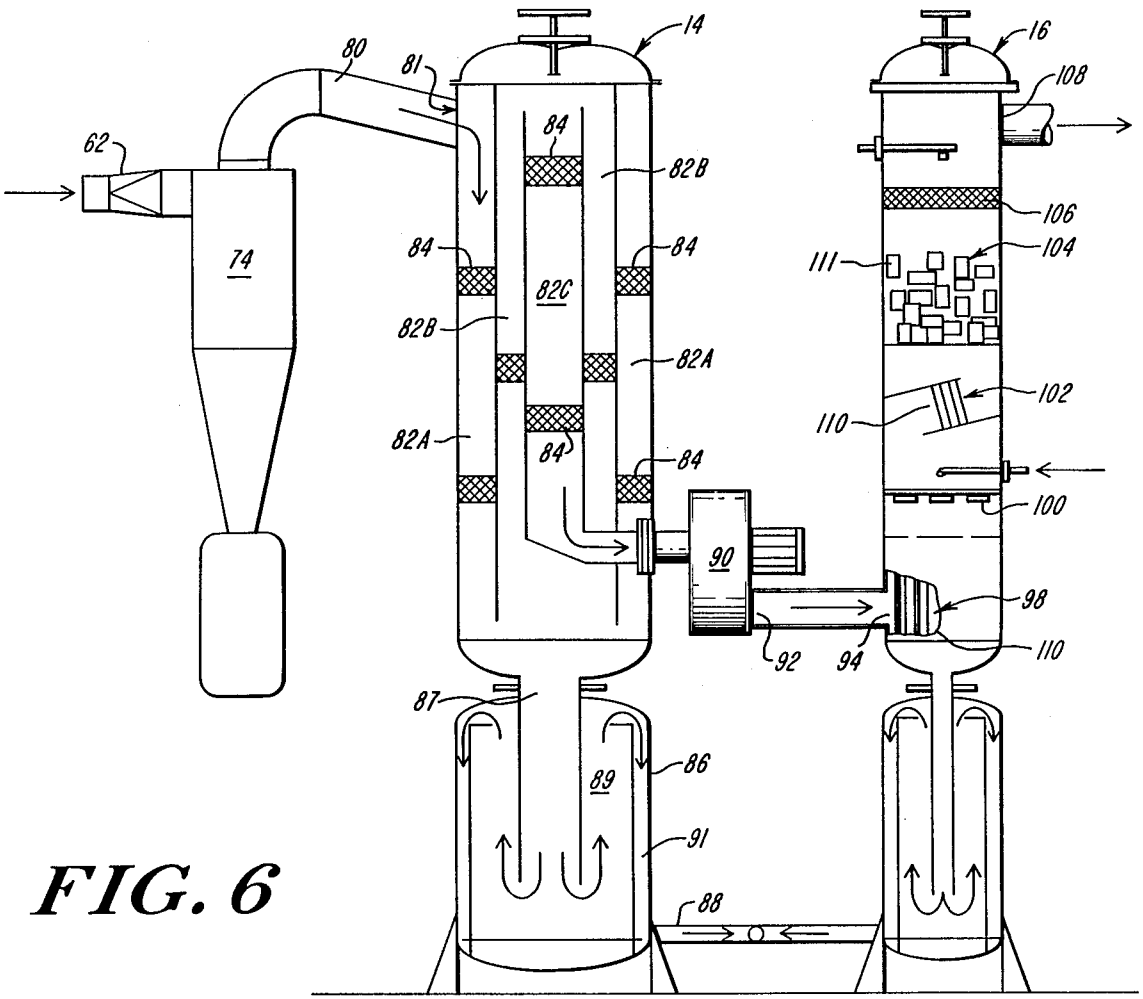
FIG. 6 is a schematic view of the scrubber and dryer apparatus of the present invention.

Conduit 80 communicates with connector 78 and thus conduits 76 and directs the gas to scrubbing and cooling apparatus 14 through scrubber inlet port 81 which preferably is mounted at the top portion of the scrubbing-/cooling vessel. Scrubber 14, as best shown in FIG. 6, is a vertically oriented vessel having a plurality of concentric chambers 82 which form a circuitous pathway. Each chamber 82 contains one or more contact points 84 which impede flow through a portion of the passageway. Contact points 84 comprise a plurality of ceramic or steel elements which act as baffles and provide a tortuous path with a relatively large surface area through which the gas must flow. A spray nozzle (not shown) is preferably disposed slightly above each contact point 84. The spray nozzles are oriented to downwardly project a spray of an aqueous cleaning solution into the gas stream and onto contact points 84 to remove particulate impurities. Moreover, larger particulate impurities adhere to the ceramic or steel elements which comprise the contact points 84.

Referring to FIG. 6, the gas stream enters the top portion of the outermost chamber 82A of scrubber 14. The gas flows downwardly through chamber 82A as it is drawn through the scrubber 14 by a vacuum force created by blower unit 90. Upon reaching the bottom of chamber 82A the gas is drawn upwardly through chamber 82B after which it proceeds through chamber 82C. The gas is then drawn out of the scrubber unit 14 and through blower unit 90, then forced into dryer 16. Additional aqueous solution may be added to the gas as it passes through blower 90.

In a preferred embodiment scrubbing and cooling unit 14 also features a collection vessel 86 disposed below the scrubber 14 and in communication with pathways 82. Waste liquid and solid debris from scrubber 14 is drawn by gravity to the bottom portion of scrubber 14 and into collection vessel 86 through waste conduit 87. Waste liquid and debris collects within holding chamber 89 of vessel 86. Generally, solid debris will fall to the bottom of vessel 86 where it is allowed to collect. When sufficient liquid is added to vessel 86 it overflows holding chamber 89 and is collected in separation channel 91. Generally, the liquid collected in channel 91 is relatively free of impurities and may be withdrawn from the system by way of conduit 88 and reused.

Water is the preferred aqueous solution for use in scrubber 14 and dryer 16. However, one skilled in the art may deem it advantageous to include detergents or other surfactants in the solution. In some instances, such as when burning a fuel having a high soot content, it may be desirable to use certain oils as a cleaning solution in order to remove soot from the gas.

Upon exiting blower 90, the gas enters dryer apparatus 16 through conduit 92 and an inlet port 94, preferably disposed in the bottom portion of dryer 16. Dryer 16 is a vertically-oriented vessel, designed to remove moisture from the gas and to further cool the gas. Gas entering dryer 16 initially passes through a first separator plate 98 and then flows upwardly through a screen-like perforated plate 100. Next, the gas flows through a second separator plate 102, followed by a baffle system 104. Finally the gas passes through a mist-eliminating screen filter 106 and exits the drying chamber through outlet 108 disposed at a top portion of dryer 16. The gas may then be directed to a prime mover 18 for generating energy.

Separator plates 98 and 102 comprise a plurality of angularly-oriented plates 110 mounted adjacent each other. The plates 110 are adapted to enable gas to flow through channels formed between the plates. The first separator plates 98 alter the flow of gas to direct it downwardly at an angle of about 20° to 30° while the second separator plate 102 similarly alters the direction of gas flow to direct it upwardly at an angle of about 20° to 30°. The downstream end of each plate features an inwardly hooked portion adapted to further interrupt the flow of gas and to remove moisture from the gas.

Perforated plate 100 is a filter-like screen which is horizontally disposed across the entire cross-section of dryer 16. A spray nozzle 109 is disposed above the plate 100 to direct a fine spray of water on top of plate 100 to form a thin layer of water on top of plate 100. This layer of water aids in removing solid impurities from the gas as the gas traverses plate 100.

Baffle system 104 represents a plurality of ceramic or steel elements which are disposed across the entire cross-section of dryer 16 and for a vertical distance of about 1 to 4 feet. Ceramic or steel elements 111 provide a tortuous path with an increased surface area through which the gas flows. Elements 111 aid in the removal of remaining moisture and impurities which may be present in the gas.

Screen filter 106 is horizontally disposed across the entire cross-section of dryer 16 and comprises a relatively fine steel mesh screen which facilitates the removal of any remaining water droplets and moisture from the gas.

Dryer 16 also has a collection vessel 92 disposed adjacent its bottom portion. The vessel 92 communicates with the main portions of dryer 16, and is of a design similar to that described above for collection chamber 86 of scrubber 14.

As noted above, the gasifier unit design described herein may apply to gasifiers having various output capacities. Accordingly, the size of the gasifier itself and its various chambers and components will vary depending upon the output capacity of the gasifier. The desired dimensions may be easily determined by one having ordinary skill in the art. Generally, however, a gasifier unit having an output capacity of approximately 180 kwe has dimensions as follows.

Figure 7:
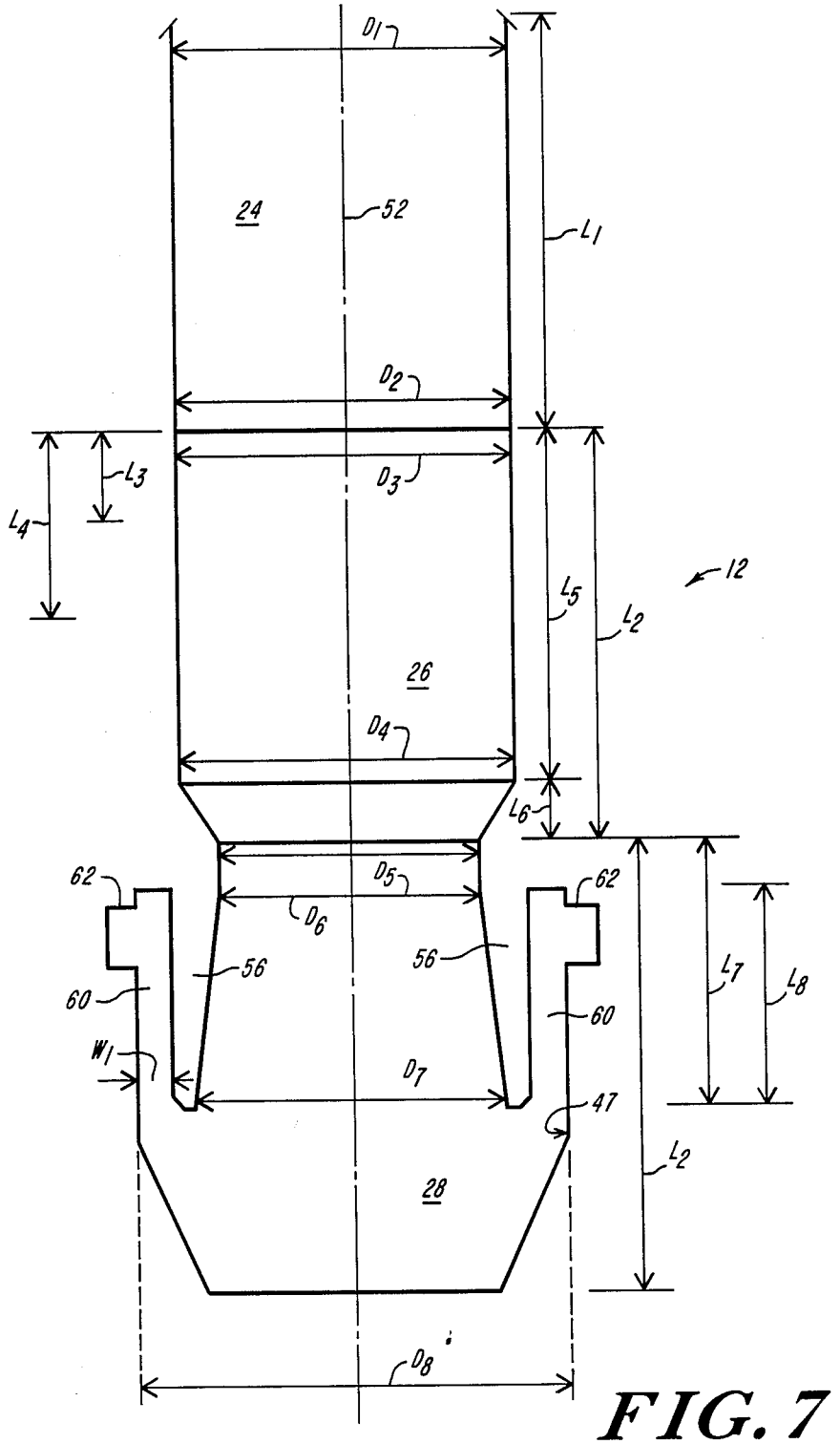
FIG. 7 is a schematic sectional view of the specific apparatus of FIG. 1, illustrating various gasified dimensions.

A gasifier apparatus according to the present invention measures approximately 5–7 meters in height from the top of hopper 20 to the base of gasifier 12. Referring to FIG. 7, the drying chamber 24 has a length ($L_1$) of about 1450 mm while the intermediate and lower chambers 26, 28 each have a length ($L_2$) which measures approximately 1000 mm.

Additionally, the drying chamber 24 measures approximately 900 mm in diameter ($D_1$) at its uppermost portion and approximately 950 mm in diameter ($D_2$) at its bottom portion. The intermediate chamber 26 has a diameter ($D_3$) at its upper portion of about 950 mm, a diameter ($D_4$) at its widest portion (just above keel region 36) of about 970 mm and a lower diameter ($D_5$) of about 770 mm. The upper diameter ($D_6$) of lower chamber 28, measured inside of the inner walls of flange 56, is also approximately 770 mm. At the base of flange 56 the diameter ($D_7$) increases to approximately 840 mm. At the widest portion of chamber 28, measured between the inner walls 47 of chamber 28 below flanges 56, the diameter ($D_8$) is approximately 1200 mm.

The nozzles 41 disposed in the walls of intermediate chamber 26 are, as noted above, present in upper and lower rows. The upper row of nozzles is preferably located a distance ($L_3$) of about 350 mm below the top portion of chamber 26. The lower row of nozzles is, in turn, located a distance ($L_4$) of about 550 mm below the top portion of chamber 26.

Still referring to FIG. 7, the keel region 36 of intermediate chamber 26 begins a distance ($L_5$) of approximately 850 mm below the top portion of chamber 26. Keel region 36 extends over a distance ($L_6$) of about 150 mm. Flange 56 extends into lower chamber 28 for a distance ($L_7$) of about 600 mm. Gas discharge pathway 60 is approximately 125 mm in width ($W_1$) as measured between the outer wall of flange 56 and the outer wall 47 of chamber 28. Moreover, the length ($L_8$) of gas discharge pathway is about 500 mm.

It is understood that the above dimensions are intended to be exemplary, and should not be read to limit the scope of this invention to covering only those gasifiers having dimensions as disclosed above. One skilled in the art may easily make modifications to the dimensions set forth above for a gasifier having an output capacity of about 180 kwe, or may construct a gasifier having a smaller or larger output capacity which necessarily will require modifications to various dimensions of the gasifier. It is further understood that the dimensions set forth above all may vary within the range of ±15% of the stated values without adversely affecting gasifier performance.

Additional exemplary dimensions which may be used with larger and smaller gasifier units are set forth in Table I. The dimensions shown in Table I correspond to the regions identified in FIG. 7.

TABLE I

Exemplary Gasifier Dimensions

| | | | | | | |
|---|---|---|---|---|---|---|
| Thermal input (kW) | 100 | 300 | 600 | 1500 | 2000 | 2500 |
| Electrical output (kWE) | 20 | 60 | 120 | 300 | 400 | 500 |
| Input % | 4 | 12 | 24 | 60 | 80 | 100 |
| Dimensions: (mm) | | | | | | |
| $D_4$ | 320 | 600 | 780 | 1250 | 1440 | 1600 |
| $D_5$ | 250 | 443 | 600 | 990 | 1140 | 1280 |
| $D_7$ | 280 | 500 | 650 | 1080 | 1250 | 1400 |
| $D_8$ | 460 | 800 | 950 | 1540 | 1760 | 1920 |
| $L_8$ | 325 | 400 | 450 | 600 | 750 | 900 |

TABLE I-continued

| Exemplary Gasifier Dimensions | | | | | | |
|---|---|---|---|---|---|---|
| $L_7$-$L_8$ | 80 | 100 | 100 | 125 | 150 | 175 |
| $L_6$ | 70 | 100 | 100 | 160 | 180 | 200 |
| $L_5$ | 500 | 600 | 800 | 900 | 950 | 1000 |
| $L_3$ | 200 | 250 | 350 | 375 | 400 | 450 |
| $L_4$ | 320 | 400 | 550 | 550 | 600 | 650 |

All values ±15%

The operation of the gasifier system 10 of the present invention is efficient and relatively simple. Fuel 11 is input through hopper 20 (and any secondary hopper). In another embodiment of the invention, the hoppers may be omitted and fuel, such as processed sewage sludge, is fed to the gasifier directly from the sludge processing equipment. The fuel of the present invention may comprise biomass material such as wood waste, wood scrap, manure or it may comprise processed sewage sludge which has been dewatered, dried and processed into a briquette-like form. Such a sewage sludge treatment process is described in U.S. Pat. Nos. 3,525,685 and 3,772,188 to Edwards. It is understood that other methods of processing sewage sludge and other sludges for use as a gasification fuel may also be practiced in conjunction with the present invention.

To initiate the fire required for the gasification process, a small amount of fuel may be placed within preliminary gasification chamber 26 and primary gasification chamber 28. This fuel is ignited, and when it begins to burn rather intensely, additional fuel is added until chambers 24, 26 and 28 are filled. While the fuel is being ignited it may be necessary to force air into chamber 26 through conduits 40 and 42 by way of fan 50. Thereafter, sufficient quantities of air to satisfy the gasification process will be drawn into chamber 26 without the aid of fan 50 as a vacuum force will be created by downstream blower unit 90.

During the gasification process, the temperature within the gasifier typically ranges from approximately 100° C., in the drying chamber, to approximately 600° C. in the vicinity of grate 66. The highest temperature (approximately 900° C.–950° C.) exist in the intermediate chamber in the vicinity of the air nozzles. The temperature decreases gradually and uniformly from the region of highest temperature to a region just above keel 36. The temperature at the keel region increases slightly to about 750° C. and thereafter decreases gradually and uniformly to a temperature of about 600° C. adjacent grate 66. Moreover, the present gasifier exhibits efficient horizontal temperature control. Thus, at any given vertical point of the gasifier, the temperature should be substantially constant throughout a cross section of the gasifier at that point.

Through the gasification reaction which occurs within chambers 26 and 28, a combustible gas (comprising approximately 47% nitrogen, 21% carbon monoxide, 1.5% methane, 20% hydrogen, 10% carbon dioxide and 0.5% oxygen) is produced. This gas is continually removed from the gasification apparatus 12 through gas discharge pathway 60 and gas discharge conduits 62 as a result of the vacuum created by blower unit 90. As previously noted, gas discharge conduits 62 are offset from 45° to 90°, and preferably 90°, from radial air inlets 40. It is believed that this configuration contributes to a greater circulation of air and combustible gas within chambers 26 and 28 and contributes to the excellent horizontal temperature control achieved by the present gasifier apparatus. The gas exits chamber 28 through discharge conduits 62 disposed on either side of gasifier apparatus 12. Each conduit 62 leads to a cyclone separator 74 which removes any large particulate matter from the gas. The gas exits the cyclone separators and travels through a conduit to the scrubber unit 14.

Once in the scrubber apparatus, gas flows from a top inlet port 81 and proceeds through concentric chambers 82. As the gas proceeds through chambers 82, it periodically encounters contact points 84 which comprise a baffle system of steel or ceramic elements to provide a large surface area over which the gas flows in order to remove solids such as particulate wastes, ash and tars. Gas flowing through chambers 82 can also be contacted with a spray of an aqueous solution to further facilitate the removal of particulates. The gas exits scrubber apparatus 14 through outlet port 88 and is drawn into a blower unit 90. At the blower 90, an aqueous solution may optionally be added to the gas in order to aid in removing any remaining solids.

Blower 90 forces the gas and aqueous solution into a bottom inlet 94 of dryer 16. The gas proceeds through a downwardly, angularly oriented first separator 98 which removes solids from the gas. Thereafter the gas proceeds upwardly through a perforated plate 100 which removes moisture and solids from the gas. As the gas flows upwardly through perforated plate 100, it next contacts a second separator plate 102 through which the gas flows upwardly at a slight angle. Second separator plate 102 also aids in the removal of solids from the gas. Beyond second separator plate 102, the gas flows through a baffle region 104. The baffle region provides a relatively large surface area over which the gas may flow in order to remove moisture and solids from the gas. Finally, the gas flows upwardly through a relatively fine mesh screen 106 which is horizontally disposed across the entire cross-section of dryer apparatus 16. Screen 106 removes any remaining moisture from the gas.

Upon exiting the dryer 16 through outlet port 108, the gas may be directed to a prime mover 18 for the production of energy.

The gasifier apparatus may also be operated in a manner different than that described above in order to provide an effective increase in the capacity of the gasifier and the BTU value of the exiting gas. For example, the gasifier may be operated as a pressurized system rather than simply as a vacuum system. In such an embodiment, it is best to utilize a gasifier apparatus having a double seal structure (e.g., utilizing seal 22 and seal 23 as shown in FIG. 8). Air may be fed into the gasifier, through an electric fan or a turbocharger attached to a downstream engine, to pressurize the gasifier up to a maximum of 30 psi. This method has been found to be effective to increase the capacity of the gasifier by up to 50%.

The gasifier apparatus may also be operated in such a way that the air fed into the gasifier is essentially free of nitrogen. In this embodiment, the exiting gas will have 85–90% less nitrogen and will thus have approximately double the BTU value than when the gasifier is operated in the conventional manner. Nitrogen may be removed from the air fed into the gasifier by conventional catalytic means, such as by way of a Xor-Box apparatus, manufactured by XorBox Corporation of Tonawanda, N.Y. Further, increases in gasifier capacity may be achieved when the nitrogen-free gas is used in a pressurized gasifier system.

Figure 10:
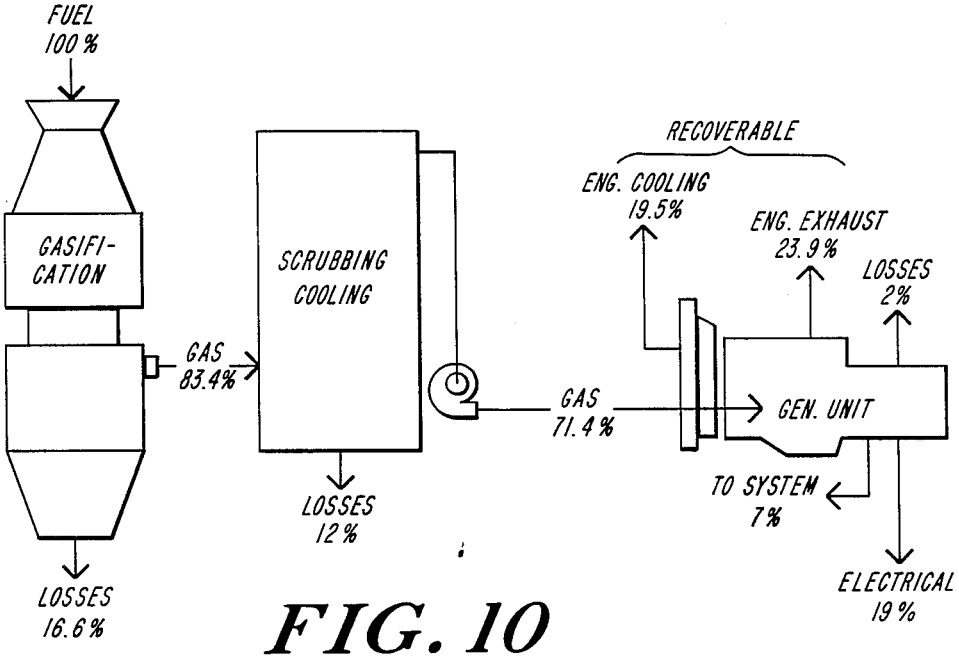
FIG. 10 is an energy flow diagram illustrating the efficiency of a gasifier system of the present invention.

FIG. 10 is an energy balance diagram for a gasifier having an output of about 180 Kwe, constructed according to the present invention. The diagram illustrates that of the fuel input to the gasifier, approximately 83% yields a combustible gas. During the cooling/scrubbing process approximately 12% of the energy is lost as the gas remaining following these processes is about 71% of the total energy available from the fuel. This gas is fed into a generator unit which may utilize energy from the gas as follows: 19% to engine cooling; 24% to engine exhaust; 2% to process losses, 7% returned to the gasifier system; and 19% of the production of electricity. Of course, the above energy balance is given by way of example only, and the actual energy balance may differ somewhat from what is stated above. Generally, however, the electrical output range between about 19% and 20%.

Having described preferred embodiments of the present apparatus, it is understood that additional modifications to this system may be made by one having ordinary skill in the art without departing from the scope of the present invention.

What is claimed is:

1. A gasifier apparatus for obtaining combustible gaseous products from solid fuel materials comprising:

a plurality of vertically aligned, modular, interconnected chamber means for housing a gasification reaction including a hopper chamber disposed at a top portion of said gasifier, a drying chamber disposed below and in communication with said hopper chamber, an intermediate chamber disposed below and in communication with said drying chamber, and a lower chamber disposed below and in communication with said pyrolysis chamber;

radial air inlet means extending through an outer skin of said gasifier for directing air into said intermediate and lower chamber means to maintain the gasification reaction;

an annular flange means, integral with an inner refractory wall of said intermediate chamber and extending downwardly into a portion of said lower chamber, for defining a gas discharge pathway within said lower chamber, said gas discharge pathway defined by the outer wall of said flange and the inner wall of said lower chamber; and first and second gas discharge conduits disposed at a top portion of said gas discharge pathway, said conduits disposed on opposite sides of said gasifier and offset by an angle of about 45° to 90° degrees from said radial air inlets.

2. Apparatus of claim 1, further comprising an axial air inlet means extending through an outer skin of said gasifier for directing air into said intermediate and lower chamber means.

3. Apparatus of claim 1 wherein said modular chamber means, are removable and replaceable with similar modules of different sizes and characteristics.

4. Apparatus of claim 3 further comprising a first sealing means for controlling the passage of fuel and air into the chambers of the gasifier, said sealing means being disposed below said hopper means, and being openable to allow fuel to pass from said hopper into the drying, intermediate and lower chambers of the gasifier, and closeable to provide an airtight seal.

5. Apparatus of claim 4 further comprising a secondary hopper means, disposed below said first sealing means, for controlling the passage of fuel and air into the chambers of the gasifier.

6. Apparatus of claim 5 further comprising a second sealing means disposed below said secondary hopper means, said second sealing means being openable to allow fuel to pass from said secondary hopper to the chambers within said gasifier, and closeable to provide an airtight seal.

7. Apparatus of claim 6 wherein said first and second sealing means each comprise a hydraulically operated sliding gate valve.

8. Apparatus of claim 6 wherein said first and second sealing means each comprise an electrically operated gate valve.

9. Apparatus of claim 1 wherein said flange means has rounded bottom ends.

10. Apparatus of claim 1 further comprising an annular manifold means disposed about the circumference of said gasifier and in communication with said radial air inlet means.

11. Apparatus of claim 10 further comprising a plurality of nozzle means disposed within the walls of said gasifier for communicating air from said manifold means to the interior chambers of said gasifier.

12. Apparatus of claim 11 wherein said nozzles are disposed in an upper row and a lower row.

13. Apparatus of claim 4 further comprising a bottom cap means for sealing the bottom portion of the gasifier from the outside and for collecting ash waste from the gasification process.

14. Apparatus of claim 13 further comprising an eccentrically rotatable grate means disposed at a bottom portion of said lower hydrolysis chamber for breaking up large ash particles and clinkers in said grate further having openings disposed therein to accommodate the passage of ash waste through said grate.

15. Apparatus of claim 14 wherein said apparatus further comprises a stirring means extending upwardly from said grate means into the intermediate chamber means of said gasifier apparatus.

16. Apparatus of claim 15 wherein said stirring means further comprises a plurality of radially disposed paddle means.

17. Apparatus of claim 4 further comprising a fan means which may be activated at the initiation of the gasifier process to provide air to said air inlet means.

18. Apparatus of claim 4 further comprising a water spray means for injecting a fine spray of water into the intermediate and lower chambers of said gasifier to control the temperature within the gasifier.

19. Apparatus of claim 1 wherein said fuel is a biomass material.

20. Apparatus of claim 1 wherein said fuel is wood scrap.

21. Apparatus of claim 1 wherein said fuel is processed, dried sewage sludge.

22. Apparatus of claim 4 further comprising a cyclone separator means in communication with said gas discharge conduits.

23. Apparatus of claim 22 further comprising a gas scrubbing means, a gas drying means and a prime mover in communication with said cyclone separator means, said scrubbing means and drying means being adapted to treat the gas prior to its use in the prime mover.

* * * * *